US008117702B2

(12) United States Patent
Woolley et al.

(10) Patent No.: US 8,117,702 B2
(45) Date of Patent: Feb. 21, 2012

(54) DEMOLITION TOOL

(75) Inventors: Christopher Woolley, Rocky Hill, CT (US); Michael Marusiak, Manchester, CT (US); Joseph Martone, Bristol, CT (US); Eric Ranieri, Besancon (FR); Russell Powers, Newington, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 925 days.

(21) Appl. No.: 11/391,230

(22) Filed: Mar. 29, 2006

(65) Prior Publication Data

US 2007/0226913 A1 Oct. 4, 2007

(51) Int. Cl.
*B25D 1/04* (2006.01)
*B25B 13/00* (2006.01)
*B66F 15/00* (2006.01)

(52) U.S. Cl. ..... 7/146; 81/20; 7/138; 7/166

(58) Field of Classification Search ..... 81/20, 25; D8/75, 81; 7/146, 147, 143, 144, 138–140, 7/166

See application file for complete search history.

(56) References Cited

U.S. PATENT DOCUMENTS

| | | | | |
|---|---|---|---|---|
| 37,920 | A | 3/1863 | Penny | |
| 89,013 | A * | 4/1869 | Blake | 7/145 |
| 292,168 | A | 1/1884 | Lytle | 7/138 |
| 439,336 | A | 10/1890 | Zitlow | |
| 486,300 | A | 11/1892 | Scheid | |
| 513,271 | A | 1/1894 | Matthews | |
| 563,848 | A | 7/1896 | Dunham | |
| 743,823 | A | 11/1903 | Bryar | |
| 845,975 | A | 3/1907 | Patterson | |
| 868,733 | A | 10/1907 | Walker | |
| 884,229 | A | 4/1908 | Sparks | |
| 914,199 | A | 3/1909 | Stiren | |
| 935,459 | A | 9/1909 | Carr | |

(Continued)

FOREIGN PATENT DOCUMENTS

CA 2 296 048 7/2001

(Continued)

OTHER PUBLICATIONS

European Search Report issued for European Patent Application No. 07251165.2-1262, dated Jul. 27, 2007.

(Continued)

*Primary Examiner* — Hadi Shakeri
(74) *Attorney, Agent, or Firm* — Pillsbury Winthrop Shaw Pittman LLP

(57) ABSTRACT

The invention provides a demolition tool that can be used in many ways for the demolition of construction materials or other materials. The demolition tool includes a handle having a head at one end. The head has a longitudinal central plane that bisects the head, a strike contact face, and toothed, stepped grasping jaws that accommodate multiple sizes of lumber or other material. The head may also include a blunt blade edge below the strike contact face for striking and demolishing material. The demolition tool includes a bent end pry bar at a second end of the handle. The bent end pry bar being offset 90 degrees from the longitudinal central plane of the tool head enabling full range of motion without interfering with other tool functions. The demolition tool may comprise a single piece of material and may be softer than tools used to strike it, but harder than materials which it is used to strike.

36 Claims, 7 Drawing Sheets

U.S. PATENT DOCUMENTS

| | | | | | |
|---|---|---|---|---|---|
| 1,114,837 | A | | 10/1914 | Wilson | |
| D55,792 | S | | 7/1920 | Hudgins | |
| 1,465,009 | A | | 12/1920 | Wasseth | |
| 1,469,472 | A | | 11/1921 | Bangert | |
| 1,472,517 | A | | 1/1922 | Fry | |
| 1,514,060 | A | | 11/1924 | McCallum | |
| 1,613,729 | A | | 1/1927 | Shearwood | |
| 1,689,685 | A | | 10/1928 | Reeves | |
| 1,763,353 | A | | 6/1929 | Heller | |
| 1,689,585 | A | | 1/1935 | Haschart | |
| D120,609 | S | | 5/1940 | Arnsbarger | D8/76 |
| 2,239,719 | A | | 4/1941 | Jarrett | |
| 2,491,129 | A | | 12/1949 | Nieuwsma | |
| D164,705 | S | | 10/1951 | Moses | |
| 2,896,910 | A | | 7/1959 | Cooper et al. | |
| 2,937,004 | A | | 5/1960 | Striani | |
| D192,721 | S | | 5/1962 | Mills | |
| 3,134,574 | A | * | 5/1964 | Reuterfors | 7/166 |
| 3,219,316 | A | | 11/1965 | Fried | 254/131 |
| 3,705,430 | A | | 12/1972 | Ziaylek, Jr. | 7/147 |
| D226,162 | S | | 1/1973 | Ziaylek et al. | |
| 3,760,656 | A | * | 9/1973 | Veach | 7/146 |
| 4,028,757 | A | * | 6/1977 | Young | 7/145 |
| 4,039,140 | A | | 8/1977 | Pulliam | |
| 4,287,623 | A | | 9/1981 | Tarran | |
| 4,408,505 | A | | 10/1983 | Cook | |
| D271,275 | S | | 11/1983 | Richilano | |
| D274,032 | S | | 5/1984 | Lai | |
| 4,476,596 | A | | 10/1984 | Fortune | |
| 4,597,123 | A | | 7/1986 | Cobe, Jr. | |
| D291,402 | S | | 8/1987 | Square | |
| D299,414 | S | | 1/1989 | Bajza et al. | D8/105 |
| D300,111 | S | | 3/1989 | Square | |
| 4,826,136 | A | | 5/1989 | Thomas | |
| D318,211 | S | | 7/1991 | D'Onofrio | |
| 5,033,501 | A | | 7/1991 | Stehling | |
| 5,044,033 | A | | 9/1991 | Fosberg | |
| D337,492 | S | | 7/1993 | Ryan et al. | |
| 5,282,287 | A | | 2/1994 | Aube | |
| D351,326 | S | | 10/1994 | Schwengel | |
| D359,220 | S | | 6/1995 | Vinar | |
| 5,428,853 | A | | 7/1995 | Menke et al. | |
| 5,456,278 | A | | 10/1995 | Morris et al. | |
| D384,264 | S | | 9/1997 | Liou | |
| D388,303 | S | | 12/1997 | Berggren | |
| D390,082 | S | | 2/1998 | Higgs | |
| 5,768,956 | A | | 6/1998 | Coonrad | |
| 5,845,354 | A | | 12/1998 | Long et al. | |
| 5,850,650 | A | | 12/1998 | Karsnia | |
| 5,896,607 | A | | 4/1999 | Hagan | |
| D422,860 | S | | 4/2000 | Vinar | |
| 6,186,475 | B1 | | 2/2001 | Selepouchin | |
| 6,220,124 | B1 | | 4/2001 | Perkins | |
| D449,770 | S | * | 10/2001 | Chen | D8/75 |
| 6,298,754 | B1 | | 10/2001 | Brown | |
| 6,352,009 | B1 | | 3/2002 | Gaidjiergis | |
| 6,435,059 | B1 | * | 8/2002 | Martinez | 81/20 |
| 6,604,728 | B1 | | 8/2003 | Boydon | |
| 6,637,061 | B1 | | 10/2003 | Spracklin et al. | |
| D496,244 | S | | 9/2004 | Boydon | |
| D499,322 | S | | 12/2004 | Hung | |
| 6,899,001 | B1 | | 5/2005 | Sanders et al. | |
| D507,167 | S | | 7/2005 | Richardson | |
| 7,033,365 | B2 | | 4/2006 | Powell et al. | |
| D525,506 | S | | 7/2006 | Downing, Jr. | |
| 2004/0045411 | A1 | | 3/2004 | Youngren et al. | |
| 2004/0261188 | A1 | | 12/2004 | Mathis | |
| 2006/0075572 | A1 | * | 4/2006 | Young | 7/138 |

FOREIGN PATENT DOCUMENTS

| | | | |
|---|---|---|---|
| DE | 199 37 951 | A1 | 3/2000 |
| DE | 20 2005 007 075 | U1 | 4/2006 |
| GB | 276509 | | 9/1926 |
| GB | 2 355 223 | A | 4/2001 |
| WO | WO 2007/038158 | | 4/2007 |

OTHER PUBLICATIONS

Printout of Stanley FUBAR demolition tool from Gizmodo.com Sep. 5, 2006.

European Search Report from related application 07122268.1, dated Mar. 5, 2008, 7 pages.

European Search Report, dtd Nov. 3, 2008, in EP Application No. 08158710.7, 7 pp.

Examination Report issued for EP Patent Application No. 08158710.7, dated Oct. 2, 2009.

Examination Report issued for EP Patent Application No. 08158710.7, dated Mar. 10, 2010.

Examination Report issued for EP Patent Application No. 08158710.7, dated Dec. 2, 2010.

* cited by examiner

DEMOLITION TOOL

BACKGROUND OF THE INVENTION

1. Field of the Invention

The invention relates to a multi-functional demolition tool and methods for the manufacture thereof.

2. Description of Related Art

There are many hand tools that are traditionally used for demolition of construction or building materials. A "crow bar," for instance, typically has a straight pry bar end attached to a long lever arm and a hooked pry bar end at its opposite terminus. Some tools have pry bar ends that are forked for use in removing nails or other fasteners and otherwise wedging into building materials. Additional demolition tools include various sledge hammers, grasping equipment, and other tools.

However, some of these demolition tools present certain drawbacks or limited capabilities. For example, typical board grasping equipment is unsuitable for successfully demolishing lumber or grasping materials or boards of different thicknesses. In addition, certain tools with pry bar ends do not enable full range of motion due to other implements located at opposite ends of the tool bottoming out on a work surface. Furthermore, the configuration of these pry bar ends often interferes with the comfortable use of the implements located at the other ends of the tool.

Other demolition tools are made from material that is not intended to be struck by a striking tool to enable it to be used in a chisel-like manner. Finally, some tools that are used for demolition, but designed for other purposes, are made from multiple parts as opposed to being integrally formed. This adds to the cost and complexity of the structure, and potentially reduces the strength thereof.

BRIEF SUMMARY OF THE INVENTION

The present disclosure relates to a demolition tool for demolishing construction material, building material, or other material. In one embodiment, the demolition tool comprises a handle with a head at a first end of the handle, the head having a longitudinal central plane. In one embodiment, the head includes a strike contact face. The strike contact face includes a flat surface that can be struck by a hammer or other striking tool or that can be used to strike building or other material for demolition purposes or for other purposes. In one embodiment, the plane or surface of the strike contact face is parallel with the main axis of the handle and perpendicular to the longitudinal central plane of the head.

In one embodiment, the head also includes grasping jaws. In one embodiment, the grasping jaws may be utilized to grasp, manipulate, and/or otherwise demolish building materials such as, for example, lumber or other building materials. The grasping jaws include one or more steps on one or both of an upper jaw or a lower jaw. The grasping jaws having one or more steps may form multiple gaps. The multiple gaps may accommodate materials or boards having different thicknesses. In some embodiments, the grasping jaws include one or more teeth on their interior grasping surfaces. In one embodiment, the opening formed by the grasping jaws is perpendicular to the main axis of the handle. In one embodiment, the grasping jaws extend generally along the longitudinal central plane of the head.

In some embodiments, the demolition tool includes a chisel blade on the opposite side of the head from the strike contact face. In one embodiment, the chisel blade is formed as part of the upper jaw of the grasping jaws. The chisel blade may be used to penetrate building materials such as wood (or other materials) for the purposes of demolition or for other purposes.

In one embodiment, the demolition tool includes a bent end pry bar at a second end of the handle. Bent end pry bar may enable the removal of fasteners such as, for example, nails, brads, staples, or other fasteners, or may enable general prying apart of materials. In one embodiment, the bent end pry bar is bent in a direction that is 90 degrees offset from the central longitudinal plane of the head. This offset enables the use of the bent end pry bar without interference from the head or any implements thereon (e.g., the grasping jaws, the strike contact surface, or other implements). Additionally, the 90 degree offset moves the bent end pry bar out of the plane of use of implements on the head.

In one embodiment, the demolition tool includes a blunt blade edge located on the head, below the strike contact face. The blunt blade edge may include a tapered wedge that may be utilized to break apart or otherwise demolish construction materials such as for example, wood, softer metals, or other materials by striking blows upon the material.

The demolition tool, including the handle, the head, the bent end pry bar, and/or other portions of the demolition tool, may comprise a single integrally molded metal material, as opposed to multiple parts jointed or fastened together. In one embodiment, the demolition tool is manufactured to weigh between 3.5 to 4.5 lbs., and in one embodiment, approximately 4 lbs. This weight provides a tool with enough mass and inertia to aid in demolition of construction materials or other materials. In one embodiment, the demolition tool may be hardened to Rockwell C 38-44. Thus, the demolition tool is softer than conventional tools that can be used to strike it, but harder than the materials it is used to strike (e.g., wood, aluminum, or other materials).

These and other objects, features, and advantages of the invention will be apparent through the detailed description of the preferred embodiments and the drawings attached hereto. It is also to be understood that both the foregoing summary and the following detailed description are exemplary and not restrictive of the scope of the invention.

DETAILED DESCRIPTION OF THE INVENTION

Figure 1:
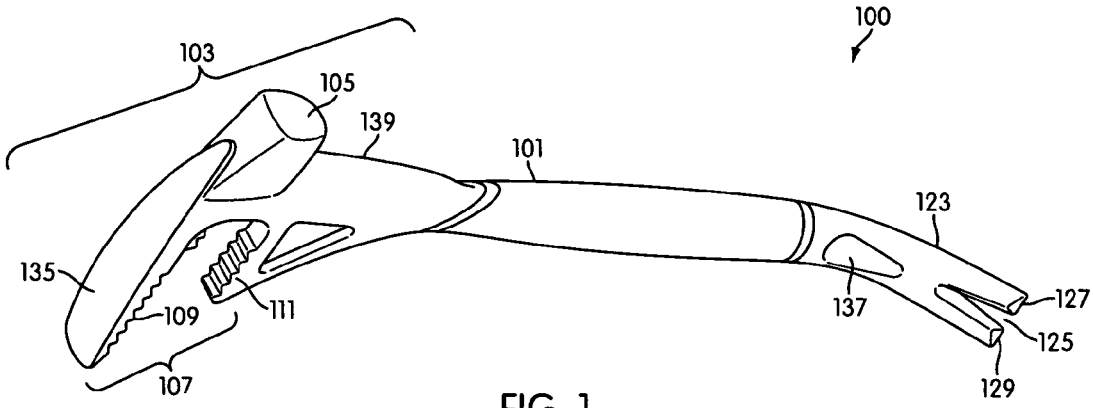
FIG. 1 illustrates a perspective view of a demolition tool according to an embodiment of the invention.
Figure 2:
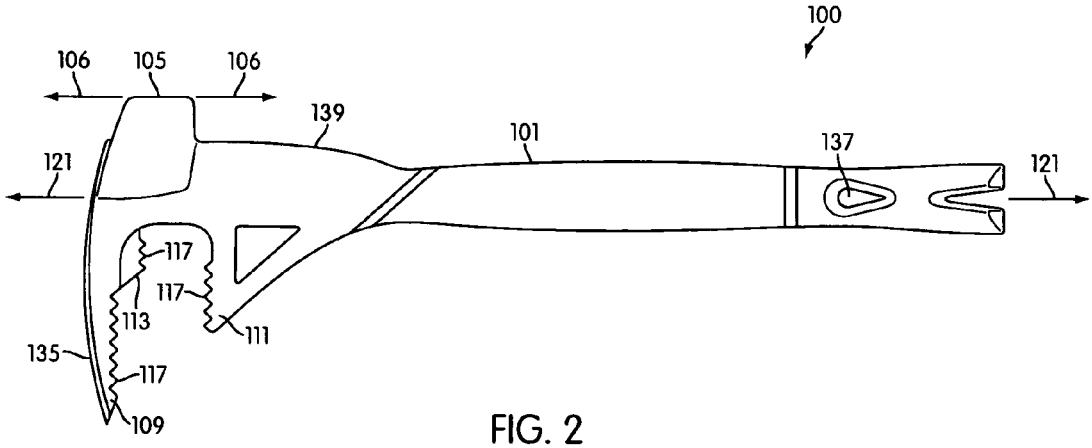
FIG. 2 illustrates a side view of a demolition tool according to an embodiment of the invention.

The invention provides a demolition tool for demolishing construction material, building material, or other material. FIG. 1 illustrates a demolition tool 100 according to an embodiment of the invention. In one embodiment, demolition tool 100 comprises a handle 101 with a head 103 at a first end of handle 101. In one embodiment, head 103 has a longitudinal central plane (plane 131 of FIGS. 4A and 4B) that bisects head 103. In one embodiment, head 103 includes a strike contact face 105. Strike contact face 105 includes a generally flat surface that can be struck by a hammer or other striking tool or that can be used to strike building or other material for demolition purposes or for other purposes. In one embodiment, the plane 106 or surface of strike contact face 105 is parallel with the main axis 121 of handle 101, as illustrated in FIG. 2.

Figure 3:
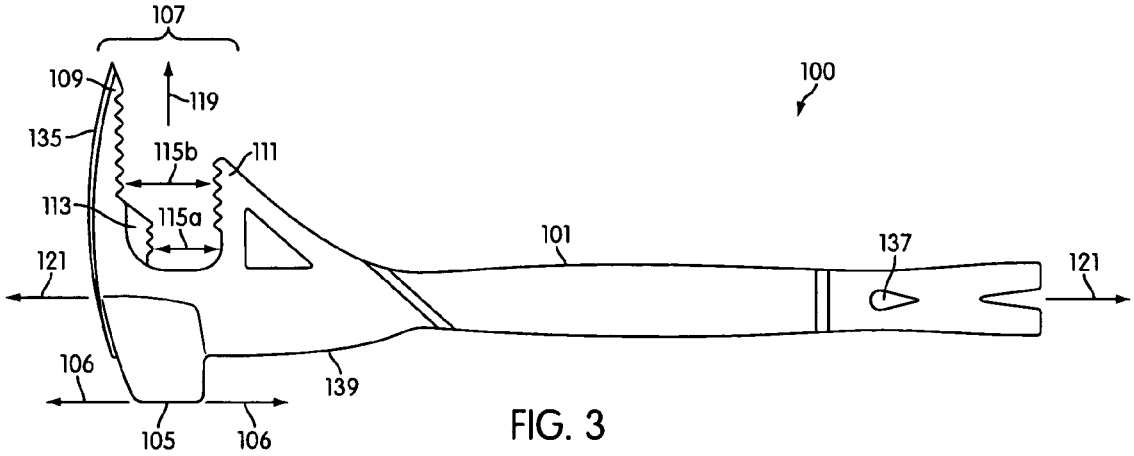
FIG. 3 illustrates a side view of a demolition tool according to an embodiment of the invention.

In one embodiment, head 103 includes grasping jaws 107. In one embodiment, grasping jaws 107 comprise an upper jaw 109 and a lower jaw 111. In some embodiments, grasping jaws 107 may be utilized to grasp, manipulate, and/or otherwise demolish building materials such as, for example, lumber or other building materials. Grasping jaws 107 include one or more steps on one or both of upper jaw 109 or lower jaw 111. FIG. 2 illustrates a side view of demolition tool 100 wherein upper jaw 109 includes a single step 113. As shown, step 113 has teeth 117. Grasping jaws 107 having one or more steps may form multiple gaps of different length within grasping jaws 107. For example, FIG. 3 illustrates a side view of demolition tool 100 according to an embodiment of the invention, wherein grasping jaws 107 include multiple gaps 115*a* and 115*b*. The multiple gaps within grasping jaws 107 may accommodate materials having different thicknesses. For instance, in one embodiment, gap 115*a* between step 113 and lower jaw 111 is approximately ¾ inches wide (or perhaps a bit narrower) so that it may accommodate lumber or other material that is ¾ inches thick, while gap 115*b* between upper jaw 109 and lower jaw 111, is approximately 1¼ inches wide (or perhaps a bit narrower) so that it may accommodate lumber or other material that is 1¼ inches thick. Other gaps having other sizes may exist.

In one embodiment, the surface on upper jaw 109 carrying or defining teeth 117 is generally parallel to the surface on lower jaw 109 carrying or defining teeth 117. Similarly, the teeth 117 on step 113 extend along a line that is generally parallel to the teeth 117 on lower jaw 111. Otherwise stated, the points of the teeth 117 on the lower jaw 111 are parallel to the points (or lines extending through the points) on the upper jaw 109 and step 113. In another embodiment, some of the steps included within grasping jaws 107 do not have teeth 117. In one embodiment, the opening formed by grasping jaws 107 is perpendicular to the main axis of handle 101. FIG. 3 illustrates opening 119, which is perpendicular to the main axis 121 of handle 101. In one embodiment, the opening formed by grasping jaws 107 extends generally along the longitudinal central plane (i.e., plane 131) of head 103.

Demolition tool 100 includes a chisel blade 135, on the opposite side of head 103 from strike contact face 105, as illustrated in FIGS. 1-4*b*. In one embodiment, chisel blade 135 is formed upon upper jaw 109 of grasping jaws 107. Chisel blade 135 may be used to penetrate building materials such as wood (or other materials) for the purposes of demolition or for other purposes. In one embodiment, chisel blade 135 may be positioned on a workpiece to be penetrated, and the strike contact face 105 may be struck by a hammer or other striking tool, such that chisel blade 135 is driven into the workpiece.

Figure 5:
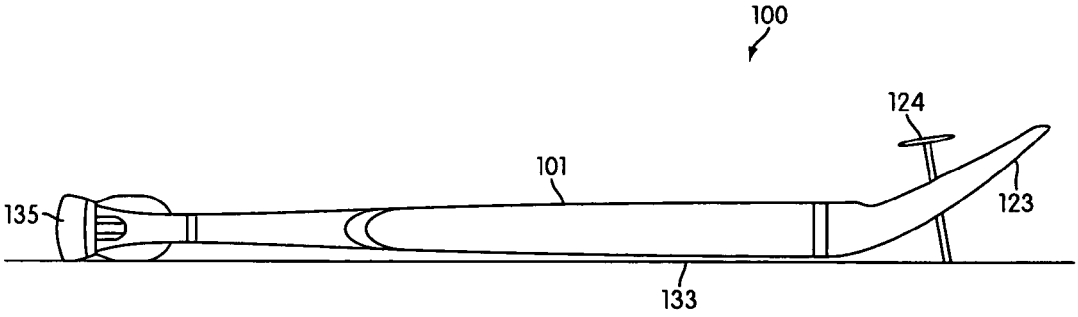
FIG. 5 illustrates a side view of a demolition tool according to an embodiment of the invention.

In one embodiment, demolition tool 100 includes a bent end pry bar 123 at a second end of handle 101. In some embodiments, bent end pry bar 123 includes a forked end having a V-shaped gap 125 in between tapered ends 127 and 129. The bent end pry bar 123 may enable the removal of fasteners such as, for example, nails, brads, staples, or other fasteners from a workpiece or may enable general prying apart of materials. FIG. 5 illustrates a side view of demolition tool 100 according to an embodiment of the invention, wherein pry bar 123 is being used to remove a fastener 124 from a work surface 133.

Figure 4A:
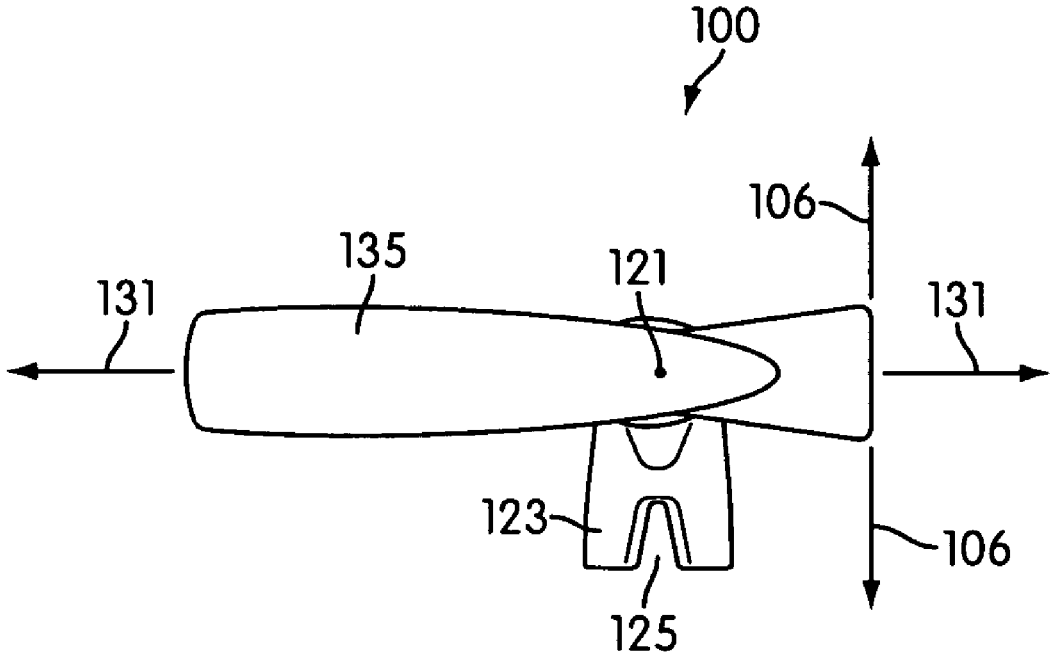
FIG. 4A illustrates an end view of a demolition tool according to an embodiment of the invention.
Figure 4B:
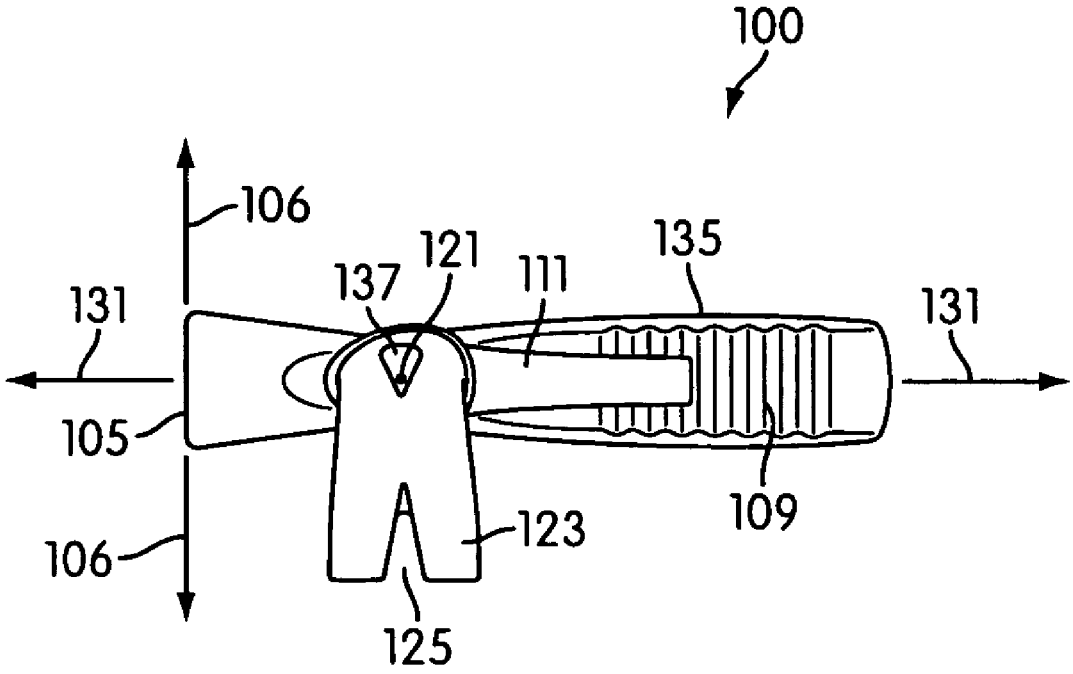
FIG. 4B illustrates an end view of a demolition tool according to an embodiment of the invention.

In one embodiment, bent end pry bar 123 is bent in a direction that is 90 degrees offset from plane 131 that bisects the head 103. FIGS. 4A and 4B illustrate end views of demolition tool 100 according to an embodiment of the invention, wherein bent end pry bar 123 is offset 90 degrees from plane 131 of head 103. This offset enables the use of bent end pry bar 123 without interference from head 103 or any implements thereon (e.g., grasping jaws 107, strike contact surface 105, or other implements). For example, bent end pry bar may be used to pry material or remove a fastener on a flat work surface (such as work surface 133 in FIG. 5) without head 103 causing demolition tool 101 to prematurely bottom out on work surface 133. A user may utilize the full range of motion bent end pry bar 123 to pry until head 103 bottoms out on work surface 133. Additionally, the 90 degree offset moves bent end pry bar 123 out of the plane of use of implements on head 103.

In one embodiment, demolition tool 100 includes an opening 137. Opening 137 may include a hole extending completely through the width of demolition tool 100. FIGS. 1-3 and 4B illustrate demolition tool 100 having opening 137 according to an embodiment of the invention. In some embodiments opening 137 is located on handle 101, on bent end pry bar 123, between bent end pry bar 123 and handle 101, or in another location on demolition tool 100. In some embodiments, opening 137 is a tear-dropped-shaped opening and enables the removal of nails, brads, or other fasteners from building materials or other materials. Opening 137 may be beveled on one or both sides (FIG. 2 illustrates a beveled side of opening 137).

Figure 6:
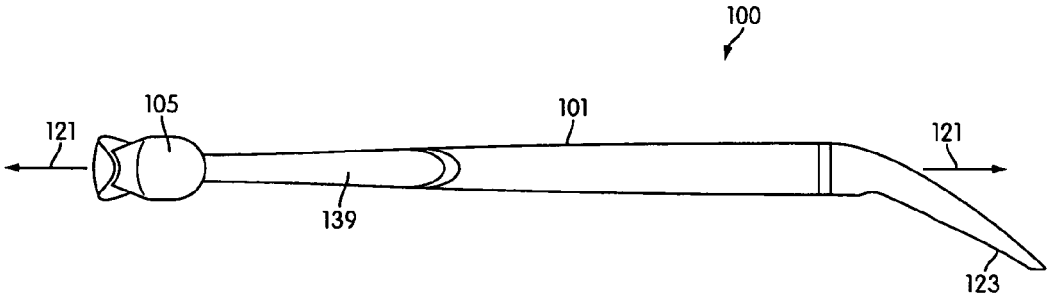
FIG. 6 illustrates a side view of a demolition tool according to an embodiment of the invention.

In one embodiment, demolition tool 100 includes a blunt blade edge 139. FIGS. 1-3 illustrate an embodiment of demolition tool 100 wherein blunt blade edge 139 is located on head 103, below strike contact face 105. FIG. 6 illustrates a side view of demolition tool 100 according to an embodiment of the invention, wherein blunt blade edge 139 is parallel to the main axis 121 of handle 101. In one embodiment, blunt blade edge 139 may exist on the same plane as the longitudinal central plane (i.e., plane 131) of head 103. Blunt blade edge 139 may include a tapered wedge that may be utilized to break apart or otherwise demolish construction materials such as for example, wood, metals, or other materials by striking blows upon the material. In some embodiments, blunt blade edge 139 is blunt enough such that it does not cut material in the same fashion as a knife, axe, or other sharp bladed tool. In other embodiments, blunt blade edge 139 has a sharp edge such as, for example, an edge similar to an axe or hatchet blade.

In one embodiment, demolition tool 100, including handle 101, head 103, bent end pry bar 123, and/or other portions of demolition tool 100, comprise a single integrally forged or molded metal material, as opposed to being formed from multiple parts jointed or fastened together.

In one embodiment, demolition tool 100 includes a grip material such as, for example, rubber, plastic, or other material on handle 101 or other portions of demolition tool 101. The gripping material may be placed over or secured to demolition tool 100 to aid in its use as a hand tool by providing a slip resistant and comfortable grip for a user's hands. In one embodiment, demolition tool 100 is manufactured to weigh approximately 3.5-4.5 lbs. and may weigh approximately 4 lbs.

As mentioned above, demolition tool 100 may be utilized in the demolition of construction or building materials. For example, demolition tool 100 may be utilized to break apart or otherwise demolish a workpiece when chisel blade 135 is placed on the workpiece and strike contact face 105 is struck by a hammer or other tool, thus, driving chisel blade 135 into the workpiece. Typically, striking tools, such as hammer heads are hardened to minimum hardness of Rockwell C 45 As such, tools or fasteners that are meant to be struck are hardened to a maximum hardness that is less than Rockwell C 45. As stated above, strike contact face 105 of the demolition tool may be struck by a hammer or striking tool to enable demolition tool 100 to be used as a chisel. As such, in one embodiment, strike contact face 105 or the entirety of demolition tool 100 may be hardened to Rockwell C 38-44. Thus, demolition tool 100 will be softer than tools used to strike it, but harder than the materials it will be used to demolish (e.g., wood, aluminum, or other materials).

To achieve a hardness of Rockwell C 38-44, certain manufacturing techniques are used. In one embodiment, demolition tool 100 is integrally formed (e.g., forged or molded) of steel and a two step heat treating process is utilized. First, demolition tool is hardened by heating the steel to between 810° C. to 870° C., and in one embodiment, between 830° C. to 850° C., and in one embodiment, approximately 840° C. At 840° C., the heat treatment temperature is maintained between 60-80 minutes, and in one embodiment, 70 minutes. After heat treatment, the tool is quenched in oil to rapidly cool to tool. At this point the steel is both hard and brittle. The second step of the process is to temper the steel, which reduces the hardness but adds toughness to the steel. Tempering is performed by heating the steel a second time to between 380° C. and 420° C., and in one embodiment, between 390° C. and 410° C., and in one embodiment, 400° C. The steel is then soaked at that temperature for between 140 and 160 minutes, and in one embodiment, 150 minutes.

In one embodiment, it is contemplated that FIGS. 1-6 are drawn to scale (i.e., not to actual size, but in proportion).

While the invention has been described with reference to the certain illustrated embodiments, the words that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the associated claims.

What is claimed is:

1. A multi-use demolition tool, comprising:

a handle having first and second ends;

a head located at the first end of the handle, the head having a longitudinal central plane;

fixed board grasping jaws, wherein the grasping jaws have one or more steps so that the jaws form multiple gaps, each gap having a different width, at least one of the widths corresponding to a specific lumber dimension, wherein each step includes one or more teeth, wherein said grasping jaws extend generally along said longitudinal central plane; and a bent end pry bar located at the second end of the handle, wherein the bent end pry bar is bent in a direction that is offset 90 degrees from the longitudinal central plane of the head, and wherein the bent end pry bar comprises a forked region and a curved portion, the forked region being joined to the second end of the handle by the curved portion.

2. The demolition tool of claim 1, wherein the head further comprises a strike contact face, wherein a surface of the strike contact face is parallel to a main axis of the handle and perpendicular to the longitudinal central plane of the head.

3. The demolition tool of claim 2, further comprising a blunt blade comprising a tapered wedge located on the head below the strike contact face, wherein a leading edge of the blunt blade is parallel with the longitudinal central plane of the head.

4. The demolition tool of claim 2 wherein the strike contact face has a hardness of between Rockwell C 38 and Rockwell C 44.

5. The demolition tool of claim 2, wherein the fixed board grasping jaws have at least an upper jaw and a lower jaw, the upper jaw upper comprising a chisel blade.

6. The demolition tool of claim 5, wherein the strike contact face and the chisel blade are positioned on opposing sides of the head such that a blow struck on the strike contact face drives the chisel blade into one or more pieces of material.

7. The demolition tool of claim 1, wherein the demolition tool is integrally formed from a single piece of material.

8. The demolition tool of claim 7, wherein the demolition tool has a hardness of between Rockwell C 38 and Rockwell C 44.

9. The demolition tool of claim 1, wherein the fixed board grasping jaws extend in a direction perpendicular to a main axis of the handle.

10. The demolition tool of claim 1, wherein the bent end pry bar comprises a forked end.

11. The demolition tool of claim 1, further comprising a teardrop shaped opening positioned between the bent end pry bar and the second end of the handle.

12. The demolition tool of claim 1, wherein the demolition tool weighs between 3.5 and 4.5 lbs.

13. The demolition tool of claim 1, wherein one of the gaps has a width approximately ¾ of an inch wide.

14. The demolition tool of claim 1, wherein one of the gaps has a width approximately 1¼ inches wide.

15. A multi-use demolition tool, comprising:

a handle having first and second ends;

a head located at the first end of the handle and having a longitudinal central plane;

a steel strike contact face, the steel having a hardness of between Rockwell C 38 and Rockwell C 44, wherein a surface of the strike contact face is generally perpendicular to the longitudinal central plane of the head, the strike contact face adapted to receive blows from tools having a hardness greater than the hardness of the strike contact face; and fixed board grasping jaws having at least an upper jaw and a lower jaw, the upper jaw comprising a unitary chisel blade, extending in a direction generally opposite the direction in which the strike contact face faces.

16. The demolition tool of claim 15, wherein the surface of the strike contact face is parallel to a main axis of the handle.

17. The demolition tool of claim 15, wherein the fixed board grasping jaws have one or more steps so that the jaws form multiple gaps, each gap having a different width, wherein each step includes one or more teeth.

18. The demolition tool of claim 15, wherein the grasping jaws extend generally along the longitudinal central plane.

19. The demolition tool of claim 15, wherein the grasping jaws extend in a direction perpendicular to a main axis of the handle.

20. The demolition tool of claim 15, wherein the strike contact face and the chisel blade are positioned on opposing sides of the head such that a blow struck on the strike contact face drives the chisel blade into one or more pieces of material.

21. The demolition tool of claim 15, further comprising a bent end pry bar located at the second end of the handle, wherein the bent end pry bar is bent in, a direction that is offset approximately 90 degrees from the longitudinal central plane of the head.

22. The demolition tool of claim 21, wherein the bent end pry bar comprises a forked end.

23. The demolition tool of claim 21, further comprising a teardrop shaped opening positioned between the bent end pry bar and the second end of the handle.

24. The demolition tool of claim 15, further comprising a blunt blade comprising a tapered wedge located on the head below the strike contact face, wherein a leading edge of the blunt blade is parallel with the longitudinal central plane of the head.

25. A multi-use demolition tool, comprising:

a handle having first and second ends;

a head located at the first end of the handle, the head having a longitudinal central plane; and fixed board grasping jaws, wherein the grasping jaws have one or more steps so that the jaws form multiple gaps, each gap having a different width, wherein the width of each gap is substantially constant along the length of the gap, at least one of the widths corresponding to a specific lumber dimension, wherein each step includes one or more teeth, wherein said grasping jaws extend generally along said longitudinal central plane.

26. The demolition tool of claim 25, further comprising a bent end pry bar located at the second end of the handle, wherein the bent end pry bar is bent in a direction that is offset approximately 90 degrees from the longitudinal central plane of the head.

27. The demolition tool of claim 26, wherein the bent end pry bar comprises a forked end.

28. The demolition tool of claim 26, further comprising a teardrop shaped opening positioned between the bent end pry bar and the second end of the handle.

29. The demolition tool of claim 25, further comprising a strike contact face on the head, wherein a surface of the strike contact face is parallel to a main axis of the handle and perpendicular to the longitudinal central plane of the head.

30. The demolition tool of claim 29, further comprising a blunt blade comprising a tapered wedge located on the head below the strike contact face, wherein a leading edge of the blunt blade is parallel with the longitudinal central plane of the head.

31. The demolition tool of claim 29, wherein the fixed board grasping jaws have at least an upper jaw and a lower jaw, the upper jaw upper comprising a unitary chisel blade.

32. The demolition tool of claim 31, wherein the strike contact face and the chisel blade are positioned on opposing sides of the head such that a blow struck on the strike contact face drives the chisel blade into one or more pieces of material.

33. The demolition tool of claim 25, wherein the fixed board grasping jaws extend in a direction perpendicular to a main axis of the handle.

34. The demolition tool of claim 25, wherein the demolition tool weighs between 3.5 and 4.5 lbs.

35. A multi-use demolition tool, comprising:

a handle having first and second ends;

a head located at the first end of the handle, the head having a longitudinal central plane;

a strike contact face, wherein a surface of the strike contact face is generally perpendicular to the longitudinal central plane of the head; and a blunt blade comprising a tapered wedge located on the head entirely below the strike contact face, such that the strike contact face does not longitudinally overlap with the tapered wedge, wherein a leading edge of the blunt blade is parallel with the longitudinal central plane of the head.

36. A multi-use demolition tool, comprising:

a handle having first and second ends;

a head located at the first end of the handle, the head including a strike contact face and having a longitudinal central plane;

fixed board grasping jaws having at least an upper jaw and a lower jaw, the upper jaw upper including a unitary chisel blade, wherein the strike contact face and the chisel blade are positioned on opposing sides of the head such that a blow struck on the strike contact face drives the chisel blade into one or more pieces of material, and wherein the grasping jaws have one or more steps so that the jaws form multiple gaps, each gap having a different width, at least one of the widths corresponding to a specific lumber dimension, each step including one or more teeth, wherein said grasping jaws extend generally along said longitudinal central plane;

a blunt blade comprising a tapered wedge located on the head below the strike contact face, wherein a leading edge of the blunt blade is parallel with the longitudinal central plane of the head;

a bent end pry bar located at the second end of the handle, wherein the bent end pry bar comprises a forked end and is bent in a direction that is offset 90 degrees from the longitudinal central plane of the head; and a teardrop shaped opening positioned between the bent end pry bar and the second end of the handle, wherein at least the head has a hardness of between Rockwell C 38 and Rockwell C 44.

* * * * *